US006185977B1

(12) United States Patent
Schiessl et al.

(10) Patent No.: US 6,185,977 B1
(45) Date of Patent: Feb. 13, 2001

(54) METHOD FOR THE PRODUCTION OF A SHEET METAL PART BY FORMING

(75) Inventors: Gerhard Schiessl, Kosching; Hans-Wilhelm Bergmann, Eckental-Brand, both of (DE)

(73) Assignee: Audi AG, Ingolstadt (DE)

( * ) Notice: Under 35 U.S.C. 154(b), the term of this patent shall be extended for 0 days.

(21) Appl. No.: 09/331,544

(22) PCT Filed: Dec. 15, 1997

(86) PCT No.: PCT/EP97/07029

§ 371 Date: Jun. 18, 1999

§ 102(e) Date: Jun. 18, 1999

(87) PCT Pub. No.: WO98/28097

PCT Pub. Date: Jul. 2, 1998

(30) Foreign Application Priority Data

Dec. 20, 1996 (DE) ..... 196 53 543

(51) Int. Cl.[7] ..... B21D 37/16
(52) U.S. Cl. ..... 72/342.1; 72/342.5
(58) Field of Search ..... 72/342.1, 347, 72/348, 349, 342.5, 342.6, 342.8, 342.94

(56) References Cited

U.S. PATENT DOCUMENTS 3,988,913 * 11/1976 Metcalfe et al. ..... 72/342.1
4,441,354 * 4/1984 Bodega ..... 72/342.1
4,522,049 * 6/1985 Clowes ..... 72/349
5,070,718 * 12/1991 Thomas ..... 72/198

FOREIGN PATENT DOCUMENTS

2332287 * 11/1975 (DE) .
4425033 * 1/1986 (DE) .

* cited by examiner

*Primary Examiner*—Rodney A. Butler
(74) *Attorney, Agent, or Firm*—Lalos & Keegan; Michael N. Lau

(57) ABSTRACT

A process of forming a sheet of metal having varying material thickness corresponding to selected strength and/or stiffness requirements generally consisting of varying the degree of heat applied during drawing of the metal to correspondingly vary the elongation coefficient of the sheet across the surface thereof.

11 Claims, 2 Drawing Sheets

METHOD FOR THE PRODUCTION OF A SHEET METAL PART BY FORMING

BACKGROUND OF THE INVENTION

The invention relates to a process for the production of a shaped sheet metal piece with different material thicknesses according to strength and stiffness requirements by deep-drawing.

The generic production process is used in particular for lightweight construction and especially in the production of motor vehicle bodies. While in the past it was conventional to design a shaped sheet metal piece in its thickness according to the area/section of highest mechanical requirements, in the meantime there has been a transition to differentiation with respect to material thicknesses relative to the locally different stiffness requirements.

A corresponding process is described for example in DE 43 07 563 C2. The patent explains a process for the production of a sheet metal structural part which has a multiple sheet structure consisting of a base sheet and in places a stiffening sheet or several stiffening sheets joined to it, the base sheet and the stiffening sheet or stiffening sheets being jointly deep-drawn. Here the stiffening sheet or stiffening sheets is or are at least partially attached to the base sheet and are permanently joined to the base sheet after deep-drawing.

One corresponding procedure is described in patent application DE 42 28 396 A1, in which in addition to a partial increase in stiffness a further objective is to reduce the oscillatory mass of flat or slightly deformed areas of the sheet metal piece and thus to increase the eigenfrequencies.

The aforementioned prior art is subject to the disadvantage that such a procedure requires relatively high expenditures with respect to production and logistics.

EP 0 486 093 B1 describes a process in which the reinforcement of partial areas of a shaped piece is done by means of a reinforcing structure element which is formed separately from a plate body to be covered and which is only subsequently joined to the likewise completely formed plate body. In this procedure the forming process is complicated and expensive.

For the sake of completeness reference is made to DE 41 04 256 A1. There, using in particular the example of body parts for passenger cars and trucks, it is explained how the highly loaded local areas (hinge seats, lock reinforcements, attachment areas for sleepers and other bearing parts) can be effectively reinforced. As a result, in this process shaped pieces are produced which have also become known as so-called "tailored blanks" (see in this regard also VDI-Reports [Association of German engineers] No. 1002, 1993, pages 45–51). In the latter citation it is shown especially using the example of inside door sheet metal how sufficient stiffness can be achieved by larger sheet metal thicknesses in the area of the hinge and lock attachment. A reduction in weight results in the thin sheet metal placed between thicker sheets. It is disadvantageous in these sheets that they can essentially only be used for shaped pieces which are not visible on the finished product. The two aforementioned publications are explicitly geared to shaped bodies which are either themselves an inner part of a combination of parts or which are reinforced by separate shaped pieces on one partial inner surface with disturbance of the outer surface.

The object of the invention is to devise a further process for the production of a shaped sheet metal piece with different material thicknesses according to strength and stiffness requirements which can be executed economically and without problems with respect to the forming process.

The approach as claimed in the invention is shown in the process features according to the characterizing part of claim 1. A shaped sheet metal piece produced in this way requires only relatively low additional production and logistic expenditures. The shaped sheet metal pieces are characterized by high surface quality and smooth transitions between the areas of differing material thicknesses.

Heating in the area of the forming for deep-drawing of steel sheets, especially austenitic steel sheet, is inherently known from DE 23 32 287 B2. In the area of force transfer on the other hand cooling takes place. Heat treatment is generally used to configure the deep-drawing process such that austenitic steel sheets can be formed. Heat treatment which varies over the surface of the sheet blank with the object of this invention, i.e., to obtain material thicknesses which differ according to strength requirements, does not take place.

Furthermore, DE 44 25 033 A1 discloses a process and a device for compression forming of workpieces, a workpiece being clamped in a clamping device and being formed by at least one compression tool. In particular there is a laser beam means which causes the workpiece to be exposed to the laser beam and heated in order to reduce flow stress and improve the capacity for deformation. The forming temperature can be adapted to different materials and can be controlled. In this way local heating of the workpiece can take place in the areas of high degrees of forming. In various embodiments it is also possible to reduce the wall thickness of the workpiece without detailing why this reduction is desirable.

DE 43 16 829 A1 furthermore describes a process for material working with diode radiation, in which the beam profile can be matched to the machining process. Possible applications include: forming and bending of a workpiece, laser beam flame cutting, welding of workpieces, removing impurities or coatings from workpieces, local heating for support of metal cutting on workpieces and soldering of workpieces.

SUMMARY OF THE INVENTION

By using high strength, higher strength and extremely high strength steel sheet for example in motor vehicle body construction the weight of parts can be reduced. But since these steels have only limited workability, their use is often precluded in certain areas of the part to be deep-drawn based on the required degree of forming dictated by function. As claimed in the invention, this defect is eliminated and the weight of parts is further reduced by different material thicknesses by the fact that the flow limit is locally reduced via locally raising the temperature before or during forming, especially deep-drawing, and the strain-hardening and forming capacity is changed. This can result in the fact that in the areas in which high strengths/stiffnesses are required for reasons of function, only little or no reduction of material thickness occurs during forming, while on the other hand in the areas in which little or no strength/stiffness requirements are imposed, the sheet metal thickness can be reduced relatively dramatically during forming, i.e., to a technically allowable degree.

DETAILED DESCRIPTION OF PREFERRED EMBODIMENTS OF THE INVENTION

Figure 1A:
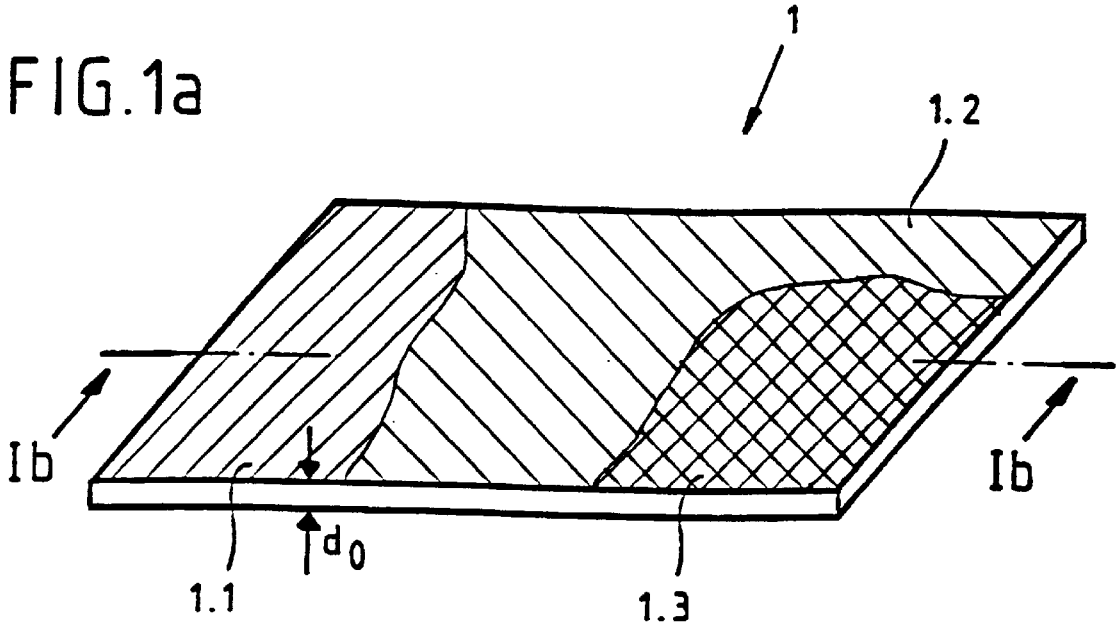
FIG. 1*a* is a perspective view of a sheet metal blank of a uniform thickness, illustrating different zones thereof having been heated differently.

Depending on the sheet metal material used, the sheet metal thickness and geometry of parts, a different flow behavior can be achieved, for example by the versions listed below.

Version A:

Local heating takes place after one of the last rolling steps; this yields coil sheets or single rolled sheets which have a deformation behavior which is matched to the later forming process. The local change of the flow behavior is achieved depending on the material, specifically for rolled steel sheet of quality St 15 the local reduction of the flow limit takes place by local recrystallization or recovery of the sheet metal material, for dual-phase steels (DP 500) the local reduction of the flow limit takes place by a local change of the martensitic and ferritic portion or by changing the martensite hardness of the martensitic phase components, for precipitation-hardened sheet metal materials the flow limit is locally reduced by local superannuation or homogenization of the sheet metal material.

Version B:

A local temperature change occurs during or directly prior to forming of the sheet metal into the shaped sheet metal piece, for example in the deep-drawing tool or in a heating or cooling device which is connected upstream of the deep-drawing device. In this way, in the area with the changed temperature the flow limit is locally changed based on its temperature dependency and the forming behavior.

Version C:

Here the sheet metal is formed in two steps. After initial deformation with a small degree of forming, subsequent final forming takes place—since the properties of the sheet metal to be formed have been changed accordingly by a local increase of temperature—with a high degree of forming mainly in the areas in which a reduction of the material thicknesses is desired.

Tests which have been run on different types of steel yielded the following:

Version A—local heating after one of the last rolling steps

The object of this version is the local change of the flow limit by heat which is added to a coil or single rolled sheet after one of the last rolling steps, but before the sheet metal is improved. In higher strength steels, steels ZStE 180 BH (bake hardening) and DP 500, in the temperature range between 200° C. and 400° C., an increase of the yield strengths by roughly 25% relative to the initial values can be ascertained. While in bake hardening steel no further strength changes occur at higher temperatures, the values drop again in the dual phase steel starting at temperatures above 550° C. and up to 25% of the highest yield strength values.

In the highest strength steels, for example TRIP 800 and CP 1000, the strength characteristics fluctuate. Relatively low strength differences of roughly 10% can be noted overall relative to room temperature strength.

Result: In the steels just discussed, as per version A it is possible to adjust local yield strength changes on coils or single rolled sheets according to a suitable shaped piece. Heat can be added, for example, using a laser.

Version B—Local heating directly before or during the forming The object of this invention is the local change of the flow limit by heat which is added to the (black) sheet directly before or during forming.

The temperature can be raised very rapidly, i.e. within seconds. In the tested steels (ZStE 180 BH, DP 500) it can be ascertained that during heating, certain areas deform dramatically, others, in turn, only slightly.

In bake hardening steel the temperature must be chosen to be preferably between 100° C. and 200° C. in order to cause local flowability, and a decrease of strength by up to 8% compared to the initial state can be expected. The moderate temperatures required in this case can be easily tolerated by the forming tool. In contrast, in the dual phase steel temperatures around 200° C. or 500° C. or more are necessary, and in certain areas the local elongation can be usefully increased. At temperatures around 200° C. a decrease of strength of at least 10% beginning at 550° C. by at least 20% compared to the initial state can occur.

In the highest strength sheet metal qualities TRIP 800 and CP 1000 a temperature of roughly 500° C. is required to useful local elongation. Here strength decreased by roughly 22% or 28% compared to the initial state.

Result: Version B is definitive for the bake hardening steel and can be conditionally used for the dual phase steel. Version B is less suited for the highest strength versions TRIP 800 and CP 1000 which require temperatures exceeding 500° C. to reduce the strength values. The required temperatures are too high for use in the forming tool. The following are possible as heat sources (temperature range: roughly 100° C. to 250° C.): oil bath, hot air blower.

For all these steel qualities the temperature range between roughly 350° C. to 450° C. seems to be irrelevant for a local change of elongation. In this area the strength is not reduced, but a strength peak which can be substantiated with the bake hardening effect occurs.

Version C—Forming in two steps

The object of version C is forming of the sheet in two steps. After the first forming step it is possible to proceed as in version B.

In conjunction with the use of the process as claimed in the invention the following considerations should be noted.

Normally, in a simple tensile test with local heating of a tension sample necking occurs preferably in the described area, since the yield strength decreases due to the increased temperature and thus an area of especially strong flow occurs.

The following relationships apply in the tensile tests:

$$\sigma = F/S^0$$

$$R_m = F_{max}/S^0$$

$$\epsilon = \Delta L/L_0 = (L - L_0)/L_0$$

Here:

$\sigma$: nominal stress $S_0$: initial cross section

F: tensile force $R_m$:tensile strength $F_{max}$:maximum tensile force $R_p$: elongation limit, for example $R_{P0.2}$ $\epsilon$: elongation $\Delta L$: extension $L_0$: initial measurement length L: respective measurement length Since the mechanical work performed during necking is converted into heat, the temperature continues to rise, with the result that strain hardening cannot increase to the degree that the flow stress decreases and ultimately the sample fails. If conversely certain differences are set in the flow limit in different areas, for example 20%/10%/5%, which can be achieved by a staggered temperature increase, this "normal", above described behavior can be avoided. The object of versions A, B and C is to set minor differences in the yield strengths with different strain-hardening behavior in the different areas.

One practical implementation can consist in that the flow limit of sheet metal material after one of the last rolling steps is locally reduced by local heating in a furnace with different heating zones by means of a burner arrangement, inductive heating or by high energy radiation sources. The areas in which the strength has been reduced can be recognized by the deep-drawing press or presses by corresponding marks on the surface of the sheet metal so that the sheet metal can be positioned accordingly in the forming tool.

One practical implementation for versions B and C can consist in that the flow limit of the sheet metal material is changed by local heating immediately prior to forming in a furnace with different heating zones by means of a burner arrangement inductively or locally by high energy radiation sources or by this taking place during forming by the action of the corresponding heat sources.

The use of measures (for example, diode radiation) according to the initially discussed prior art would also be conceivable.

The possibilities inherent in the process as claimed in the invention for creating different strengths and material thicknesses of the shaped sheet metal piece can be further expanded if the blank to be formed into the shaped sheet metal piece is composed of for example two joined (welded) component sheets of different steel materials and/or different sheet metal thicknesses.

Figure 1B:
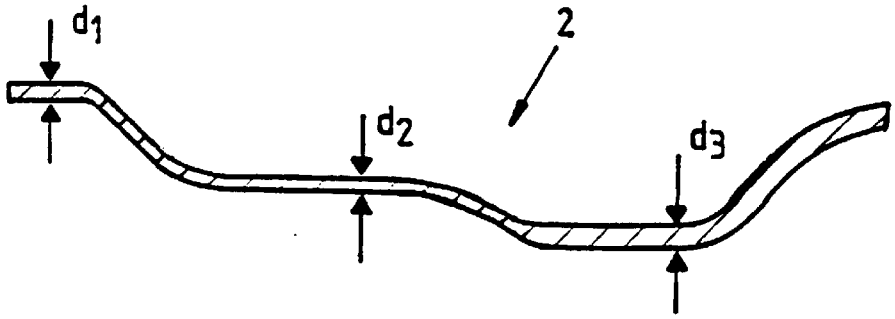
FIG. 1*b* is a vertical cross sectional view of the blank shown in FIG. 1*a* after the blank has been plastically deformed to provide zones of different thicknesses formed in accordance with the present invention.

In the drawings FIG. 1*a* shows a sheet metal blank 1 with an initial sheet thickness $d_0$ and with areas 1.1, 1.2, 1.3, which have been heat treated with different intensity, while FIG. 1*b* shows the sheet metal blank 1 formed into a shaped sheet metal piece 2 in cross section, showing that areas with different sheet metal thicknesses d1, d2 and d3 also formed.

Figure 2A:
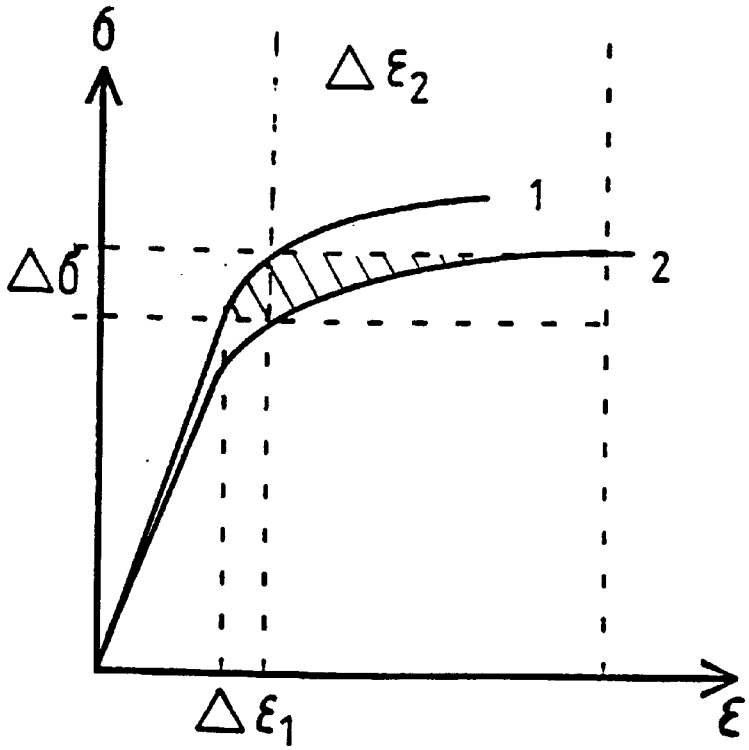
FIGS. 2*a* and 2*b* illustrates different yield strengths utilizing different strain hardening treatment with respect to the blanks shown in FIGS. 1*a* and 1*b*, following the process of the present invention.
Figure 2B:
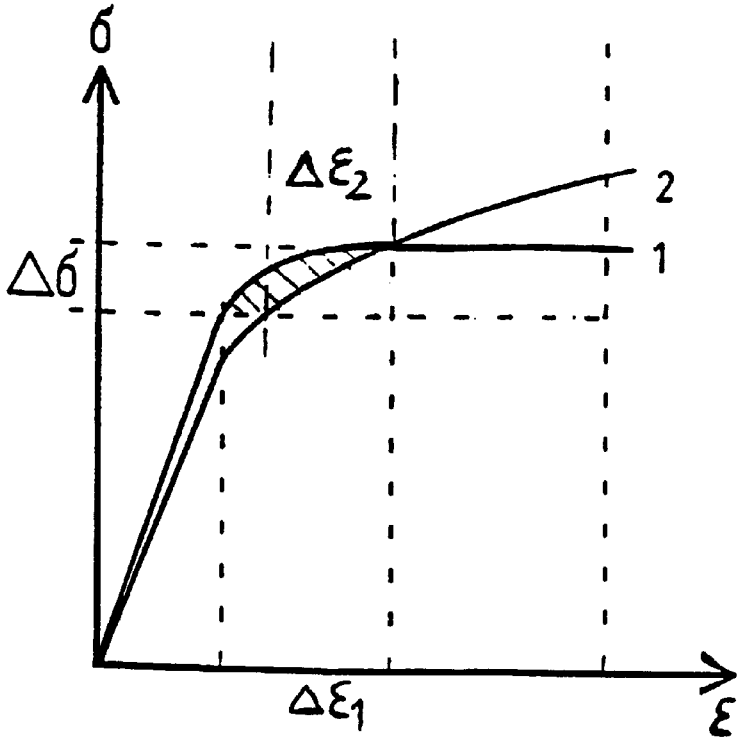

FIG. 2 shows different yield strengths with differing strain-hardening behavior using the two examples in FIGS. 2*a* and 2*b*, occuring after the corresponding heat treatment in different areas of the sheet metal blank 1. Sections in which the two material areas can flow plastically are cross-hatched. This is illustrated using $\sigma/\epsilon$ diagrams.

Initial situation: In a material there are two different material states 1 and 2 next to one another with different tensile strengths $R_m^1$ and $R_m^2$ and elongation limits $R_p^1$ and $R_p^2$.

In a material which has areas with different tensile strengths/elongation limits, the following conditions must be met so that the two material areas can flow plastically at a stipulated stress without a fracture occurring.

Conditions:

1) $R_p^2 < R_p^1 < \sigma$

2) $\sigma <$ minimum ($R_m^2$ and $R_m^1$)

for 1)

The applied stress must be greater than the higher of the two elongation limits so that the two material areas deform plastically.

but at the same time for 2)

must be smaller than the smaller of the two tensile strengths so that the material cannot fail.

In FIGS. 2*a* and 2*b*):

□: areas of possible elongation with stipulation of a stress within the allowable area $\Delta\sigma$ 1,2: material state 1 and 2 with $R_m^1$ and $R_m^2$ and and $R_p^1$ and $R_p^2$ $\Delta\sigma$: allowable stress range in which the two material areas flow plastically without the material failing $\Delta\epsilon_{1,2}$: elongation range for material area 1 and 2 which belongs to the allowable stress range $\Delta\sigma$.

What is claimed is:

1. A process of forming a metal article of varied thicknesses comprising:

effecting a temperature gradient in a metal sheet to produce at least two zones having different strain coefficients; and plastically deforming said sheet while heated to provide correspondingly varied thicknesses of said zones.

2. A process according to claim 1 wherein a selected zone to be reduced in thickness is heated prior to plastically deforming said sheet.

3. A process according to claim 1 wherein a selected zone to be reduced in thickness is heated during plastic deformation of said sheet.

4. A process according to claim 1 wherein said plastic deformation is effected by drawing said sheet.

5. A process according to claim 1 wherein said metal is steel.

6. A process according to claim 1 wherein said metal sheet comprises two joined plies of different steel materials.

7. A process according to claim 1 wherein the sequences of steps are repeated.

8. A process according to claim 1 when said metal sheet is formed by rolling and is further processed, and the sequence of steps is performed between said rolling and further processing.

9. A process according to claim 5 wherein the difference of temperatures between said zones is in the range of 100° C. and 200° C.

10. A process according to claim 7 wherein said metal sheet is formed of a steel material, the difference in temperatures between said zones in the first sequence of steps is in the range of 100° C. and 200° C. and the difference in temperatures between said zones in the second sequence of steps is in the range of 200° C. and 400° C.

11. A process according to claim 10 wherein a selected zone to be reduced in thickness in the second sequence of steps is heated between the first and second sequence of steps.

* * * * *